US009362701B2

(12) United States Patent
Wasilko et al.

(10) Patent No.: US 9,362,701 B2
(45) Date of Patent: Jun. 7, 2016

(54) SHEAR GUIDE FOR A TERMINAL CRIMPING MACHINE

(71) Applicant: Tyco Electronics Corporation, Berwyn, PA (US)

(72) Inventors: John Wasilko, Harrisburg, PA (US); Brian Weaver, Harrisburg, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 114 days.

(21) Appl. No.: 14/032,002

(22) Filed: Sep. 19, 2013

(65) Prior Publication Data

US 2015/0074991 A1 Mar. 19, 2015

(51) Int. Cl.
*H01R 43/048* (2006.01)
*H01R 43/052* (2006.01)
*H01F 41/06* (2016.01)

(52) U.S. Cl.
CPC ..... *H01R 43/052* (2013.01); *H01F 41/06* (2013.01); *Y10T 29/53235* (2015.01)

(58) Field of Classification Search
CPC ..... H01R 43/052; H01F 41/00
USPC ..... 29/753, 758, 762–768, 564.4, 33 M
See application file for complete search history.

(56) References Cited

U.S. PATENT DOCUMENTS

| | | | | |
|---|---|---|---|---|
| 3,710,610 | A * | 1/1973 | McCaughey | 72/409.06 |
| 3,997,956 | A * | 12/1976 | McKee | 29/564.1 |
| 4,363,167 | A * | 12/1982 | Boutcher et al. | 29/863 |
| 4,682,400 | A * | 7/1987 | Casey | 29/564.7 |
| 4,831,727 | A * | 5/1989 | Johnson et al. | 29/866 |
| 5,661,898 | A * | 9/1997 | Matsuzawa | 29/753 |
| 2008/0168653 | A1 * | 7/2008 | Chikyu | 29/863 |

* cited by examiner

*Primary Examiner* — Minh Trinh

(57) ABSTRACT

A shear guide for a terminal crimping machine includes a body having a shear edge configured to face a terminal used to splice a magnet wire and a lead wire. A magnet wire channel is formed by the body and is configured to receive and hold the magnet wire. A lead wire channel is formed by the body and is configured to receive and hold the lead wire. The lead wire channel is vertically offset with respect to the magnet wire channel. The body may include a platform and a separating wall positioned vertically above the platform with a slot defined between the separating wall and the platform. The slot may receive the magnet wire and the separating wall may support the lead wire above the separating wall.

20 Claims, 5 Drawing Sheets

SHEAR GUIDE FOR A TERMINAL CRIMPING MACHINE

BACKGROUND OF THE INVENTION

The subject matter described and/or illustrated herein relates generally to a shear guide for a terminal crimping machine.

Magnet wires are used to form coil windings for a variety of electrical devices. When energized, the coil windings generate magnetic fields and electromagnetic forces to drive, for example, a rotor of an electric motor. When the magnet wire is installed into a stator structure of the motor, the windings cause the rotor to rotate when the stator windings are energized. To supply power to the windings, power splice terminals are sometimes employed to couple a power lead wire to the magnet wires.

One type of power splice terminal includes an open barrel terminal which accepts a lead wire or lead wires as well as one or more magnet wires used in the coil windings. When the lead wires and the magnet wires are loaded into the open barrel, the terminal is crimped or bent to secure the wires to the terminal. The crimp barrel includes serrations formed therein which pierce the insulation of the magnet wires to establish electrical connection to the terminal when the terminal is crimped. Electrical connections of the lead wires and the magnet wires through the terminal are therefore established.

Loading the wires into the terminal, however, is problematic. For instance, the magnet wires must be positioned along the bottom of the open barrel terminal to engage the serrations. Positioning the magnet wires efficiently and correctly relative to the terminal and the lead wires can be challenging. Ensuring that the positions of the wires remain unchanged during the crimping process is also problematic. If the magnet wires are not positioned properly, the electrical connection through the terminal may be compromised, and the associated electrical device may not function properly.

A need remains for a device that holds the positions of the wires within the splice terminal during the crimping process.

BRIEF DESCRIPTION OF THE INVENTION

In one embodiment, a shear guide is provided for a terminal crimping machine that includes a body having a shear edge configured to face a terminal used to splice a magnet wire and a lead wire. A magnet wire channel is formed by the body and is configured to receive and hold the magnet wire. A lead wire channel is formed by the body and is configured to receive and hold the lead wire. The lead wire channel is vertically offset with respect to the magnet wire channel.

Optionally, the magnet wire channel may be offset vertically below the lead wire channel. The magnet wire channel may be horizontally offset with respect to the lead wire channel. The shear guide may include a second magnet wire channel. The shear guide may include a second lead wire channel.

Optionally, the magnet wire channel may include side walls meeting and a bottom thereof with an open top opposite the bottom. The lead wire channel may include side walls meeting at a bottom thereof with an open top opposite the bottom of the lead wire channel. The bottom of the magnet wire channel may be offset at a lower vertical plane than the bottom of the lead wire channel.

Optionally, the shear guide may include a guide wall adjacent the lead wire channel. The guide wall may guide the lead wire into the lead wire channel. The shear guide may include a separating wall separating the lead wire channel from the magnet wire channel. The lead wire channel may be positioned above the separating wall. The magnet wire channel may be positioned below the separating wall. The lead wire channel may be formed in the separating wall.

Optionally, the body may include a platform. The magnet wire channel may be a notch formed in the platform. The lead wire channel may be defined by a notch formed in the platform. A separating wall may be positioned vertically above the platform with a slot defined between the separating wall and the platform. The slot may be configured to receive the magnet wire. The separating wall may support the lead wire above the separating wall.

Optionally, the magnet wire channel may restrict horizontal movement of the magnet wire received in the magnet wire channel. The magnet wire channel may restrict vertical movement of the magnet wire received in the magnet wire channel.

In another embodiment, a terminal crimping machine is provided that includes crimp tooling for crimping an electrical terminal to magnet wires and lead wires and a shear guide positioned adjacent the crimp tooling. The shear guide includes a body having a shear edge configured to face the electrical terminal and crimp tooling. A magnet wire channel is formed by the body and is configured to receive and hold the magnet wire. A lead wire channel is formed by the body and is configured to receive and hold the lead wire. The lead wire channel is vertically offset with respect to the magnet wire channel.

DETAILED DESCRIPTION OF THE INVENTION

Figure 1:
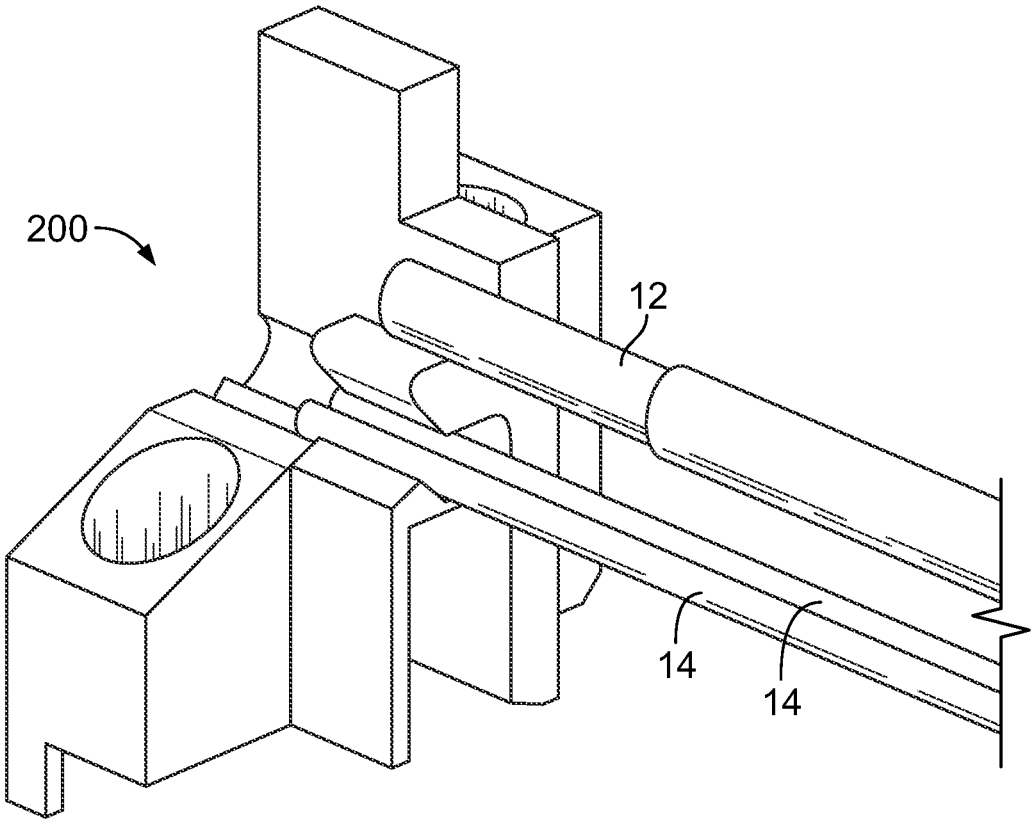
FIG. 1 illustrates a shear guide formed in accordance with an exemplary embodiment.

FIG. 1 illustrates a shear guide 200 formed in accordance with an exemplary embodiment. The shear guide 200 is configured for use with a terminal crimping machine 100 (shown in FIG. 3) that is used to terminate an electrical terminal 10 (shown in FIG. 2) to wires 12, 14. The shear guide 200 is used to shear ends of the electrical terminal 10 and/or wires 12, 14 that are crimped by the electrical terminal 10. The shear guide 200 is used to support ends of the wires 12, 14 within the electrical terminal 10 during the crimping process. The shear guide 200 is used to position the wires 12, 14 relative to one another and relative to the electrical terminal 10 for crimping. The shear guide 200 includes alignment features for properly positioning the wires 12, 14, as described in further detail below.

Figure 2:
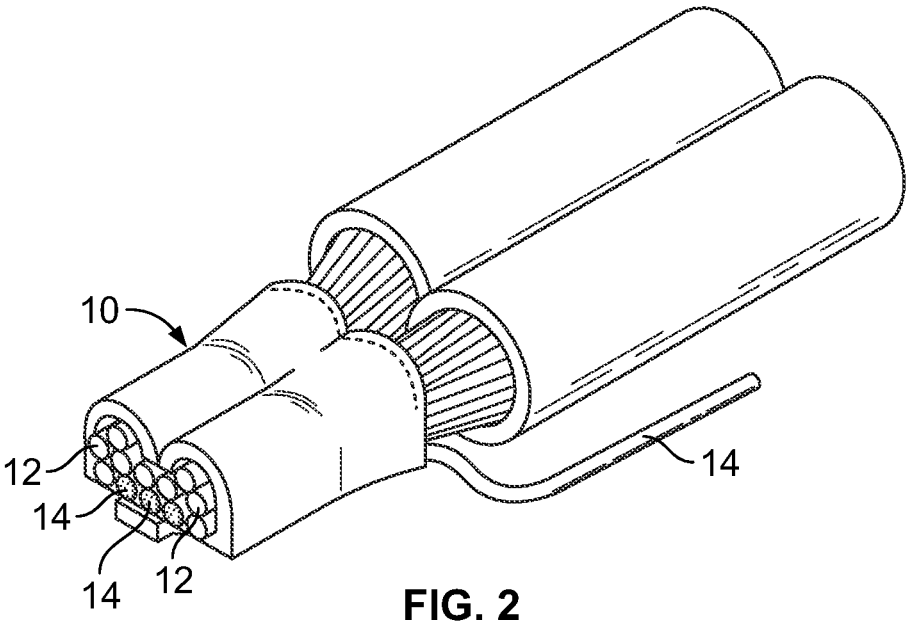
FIG. 2 is a perspective view of an exemplary embodiment of an electrical terminal used to splice one or more lead wires with one or more magnet wires.

FIG. 2 is a perspective view of an exemplary embodiment of an electrical terminal 10 used to splice one or more lead wires 12 with one or more magnet wires 14. Each lead wire 12 may include a plurality of copper strands that are held in a common cable jacket. The electrical terminal 10 is crimped around exposed ends of the lead wires 12 and the magnet wires 14. An electrical connection is created between the magnet wires 14 and the electrical terminal 10 as well as between the lead wires 12 and the electrical terminal 10. The electrical terminal 10 and wires 12, 14 may be used in coil winding applications in electrical devices. For example, the magnet wires 14 may be used as coil windings that, when energized, generate magnetic fields and electromagnetic forces to drive, for example, a rotor of an electric motor. The lead wires 12 supply power to the magnet wires 14 via the splice connection of the electrical terminal 10.

Figure 3:
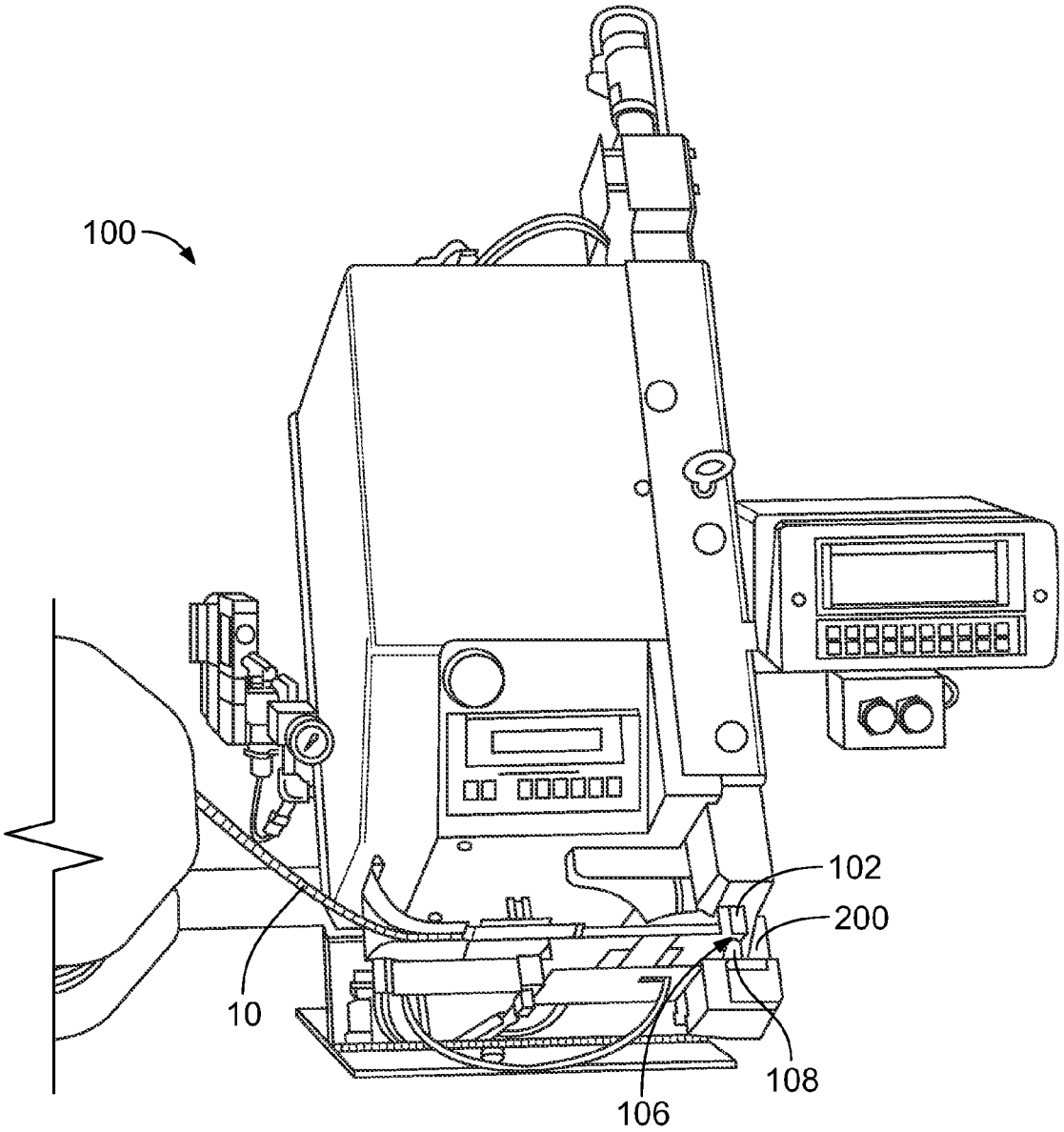
FIG. 3 is a perspective view of a terminal crimping machine that uses the shear guide to assist in crimping the terminal to the lead wire(s) and the magnet wire(s).

FIG. 3 is a perspective view of an exemplary embodiment of a terminal crimping machine 100 that may be used to crimp the terminal 10 to the lead wire(s) 12 and the magnet wire(s) 14 (both shown in FIG. 2). The terminal crimping machine 100 may be any type of terminal crimping machine, such as an applicator, terminator, press, lead maker, bench machine, hand tool or other type of crimping machine, that includes crimp tooling 102.

The terminal crimping machine 100 has a terminating zone or crimping zone 106 that receives the terminal 10 and the wires 12, 14. The shear guide 200 is positioned at the crimping zone 106 to hold the wires 12, 14. The terminals 10 are fed to the crimping zone 106 for crimping by the crimp tooling 102. Once the wires 12, 14 are positioned in the terminal 10, the crimp tooling 102 is driven through a crimp stroke by a driving mechanism of the terminal crimping machine 100 toward a stationary anvil 108. The driving mechanism may be a ram or other mechanical component cyclically driven through the crimp stroke. The crimp stroke has both an advancing or downward component and a return or upward component. The crimp tooling 102 is advanced downward toward the anvil 108 to a seated position and is returned upward to a released position. As the crimp tooling 102 presses through the crimp stroke, the shear guide 200 shears the ends of the wires 12, 14 beyond the terminal 10. The shear guide 200 may be used to shear a portion of the terminal 10, such as a tab or other component that connects the terminal 10 to a carrier used for feeding the terminal 10.

Figure 4:
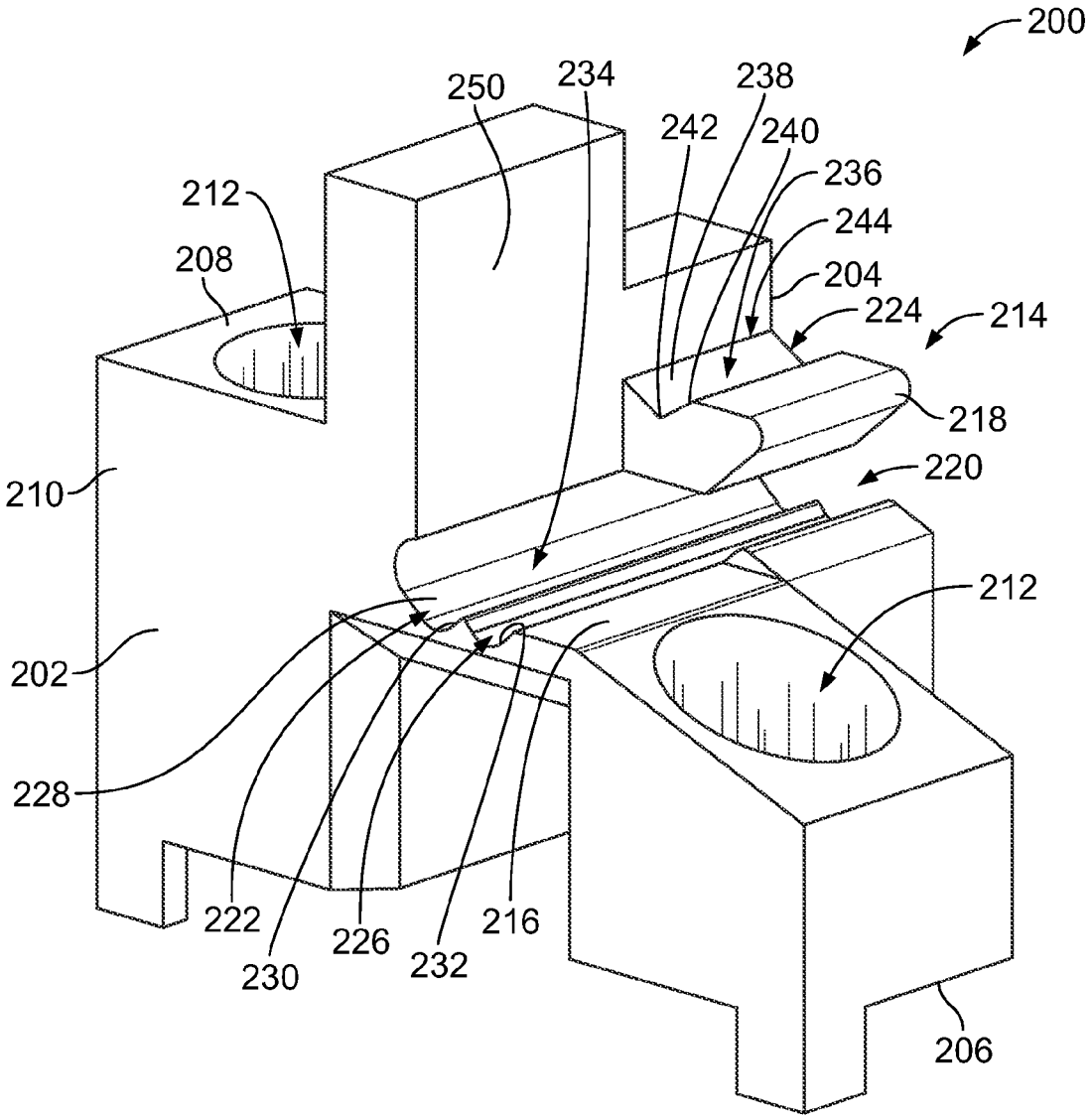
FIG. 4 is a perspective view of the shear guide formed in accordance with an exemplary embodiment.
Figure 5:
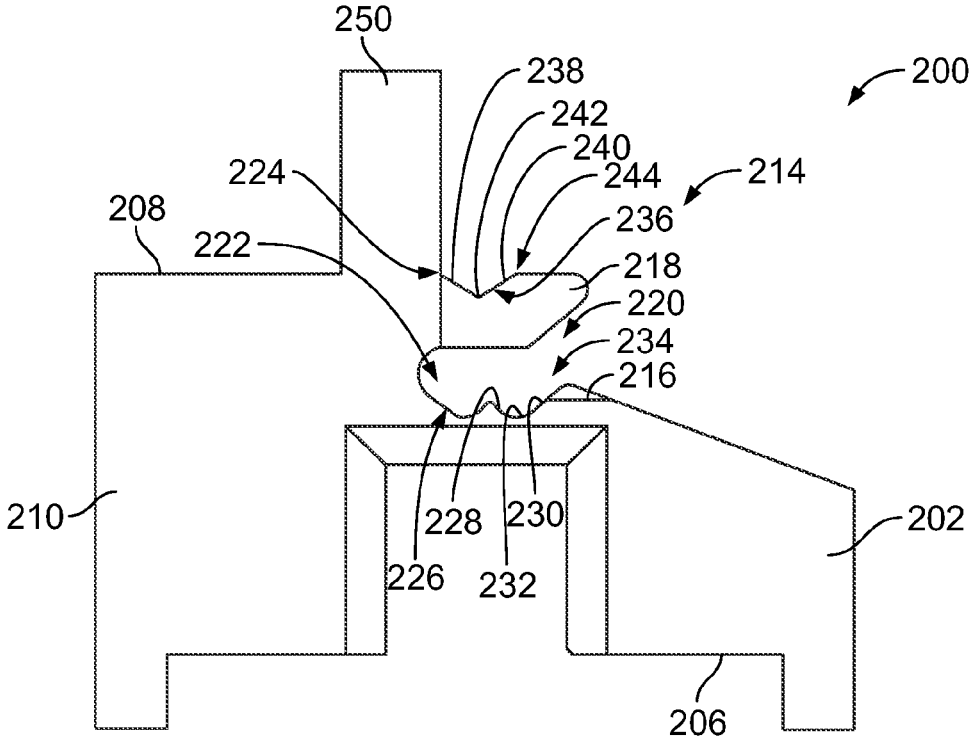
FIG. 5 is a front view of the shear guide.
Figure 6:
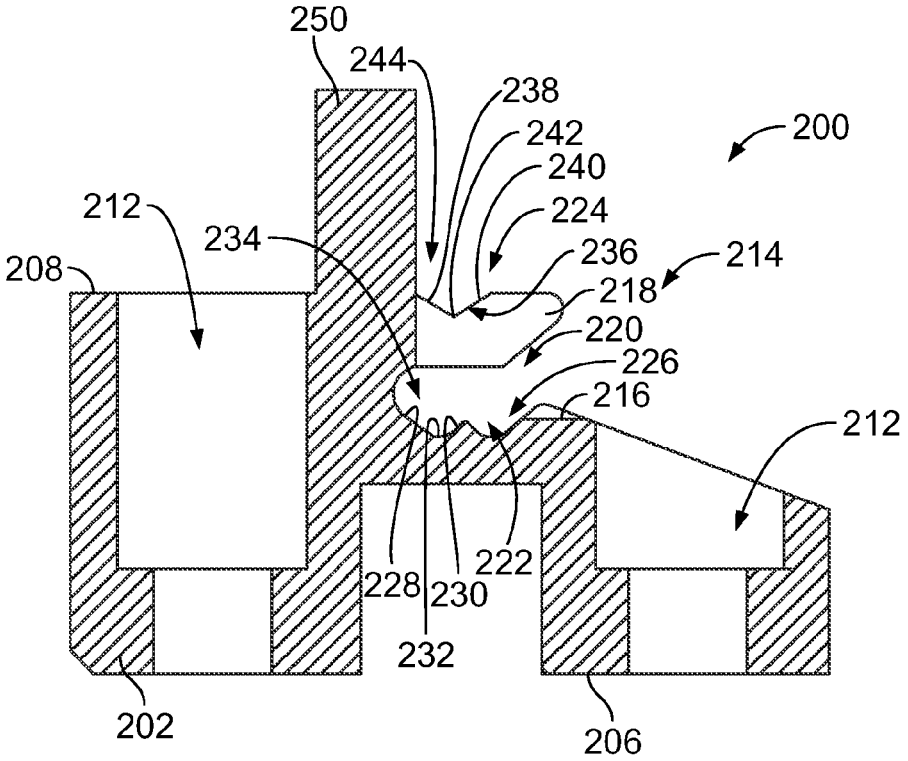
FIG. 6 is a cross sectional view of the shear guide.

FIG. 4 is a perspective view of the shear guide 200 formed in accordance with an exemplary embodiment. FIG. 5 is a front view of the shear guide 200. FIG. 6 is a cross sectional view of the shear guide 200. The shear guide 200 includes a body 202 having a shear edge 204 at a front of the body 202. The shear edge 204 faces the crimping zone 106 (shown in FIG. 3) and the wires 12, 14 (shown in FIG. 1) extend from the crimping zone 106 into the shear guide 200. During the crimping operation, or after the crimping operation, the wires 12, 14 may be sheared or cut off at the shear edge 204. The shear guide 200 supports the wires 12, 14 during such shearing operation to make the shearing process easier.

The body 202 has a bottom 206, a top 208 and a rear 210 opposite the shear edge 204. The body 202 includes bores 212 extending therethrough. The bores 212 may receive fasteners or other securing means to secure the shear guide 200 to the terminal crimping machine 100 (shown in FIG. 3). Optionally, the shear guide 200 may be coupled to the anvil 108 (shown in FIG. 3) or another structure of the terminal crimping machine 100, such as a frame of the terminal crimping machine 100. The bottom 206 may be mounted to the terminal crimping machine 100 and fasteners may be received in the bores 212 to secure the shear guide 200 to the terminal crimping machine 100.

The shear guide 200 includes a wire receiving area 214 generally above the top 208. The wire receiving area 214 receives the wires 12, 14. The shear guide 200 holds the wires 12, 14 within the wire receiving area 214 during the crimping process. The shear guide 200 positions the wires 12, 14 relative to one another and relative to the electrical terminal 10 (shown in FIG. 2) that is positioned forward of the shear edge 204.

In an exemplary embodiment, the shear guide 200 includes a platform 216 generally along the top 208 of the body 202. The platform 216 defines a surface that supports one or more of the wires 12 and/or 14. In an exemplary embodiment, the shear guide 200 includes a separating wall 218 positioned vertically above the platform 216. The separating wall 218 supports one or more of the wires 12 and/or 14. A slot 220 is defined between the separating wall 218 and the platform 216. At least some of the wires 12 and/or 14 are received in the slot 220 and supported by the platform 216. In the illustrated embodiment, the magnet wires 14 are received in the slot 220 and supported by the platform 216 while the lead wires 12 are positioned above, and supported by, the separating wall 218. The separating wall 218 separates the magnet wires 14 from the lead wires 12.

The shear guide 200 includes one or more magnet wire channels 222 formed by the body 202 that receive and hold corresponding magnet wires 14. The slot 220 is open at one side thereof to allow the magnet wires 14 to be loaded into the magnet wire channels 222 through the open side of the slot 220.

The shear guide 200 includes one or more lead wire channels 224 formed by the body 202 that receive and hold corresponding lead wires 12. In an exemplary embodiment, the lead wire channel 224 is vertically offset with respect to the magnet wire channel 222. For example, the magnet wire channels 222 may be offset vertically below the lead wire channels 224. As such, the magnet wires 14 may be positioned below the lead wires 12 and held below the lead wires 12 within the terminal 10 during the crimping process.

In an exemplary embodiment, the magnet wire channels 222 are formed by notches 226 in the platform 216. The magnet wires 14 may be loaded into the slot 220 below the separating wall 218 and loaded into corresponding notches 226. Any number of magnet wire channels 222 may be provided in the body 202. Optionally, the magnet wire channels 222 may be arranged along a common horizontal plane that may be elevated just above the bottom of the electrical terminal 10 within the crimping zone 106.

The magnet wire channel 222 includes side walls 228, 230 meeting at a bottom 232 of the magnet wire channel 222. The magnet wire channel 222 has an open top 234 that receives the magnet wire 14. Optionally, the side walls 230 may define a V-shaped notch 226 that receives the magnet wire 14 therein. The notches 226 may have other shapes in alternative embodiments, such as a U-shape. The magnet wire channel 222 may receive the magnet wire 14 such that a portion of the magnet wire 14 is positioned out of and above the magnet wire channel 222. The side walls 228 may hold the magnet wire 14 to restrict horizontal movement (e.g. side-to-side movement) of the magnet wire 14 once the magnet wire 14 is positioned in the magnet wire channel 222. The magnet wire channel 222 may restrict vertical movement of the magnet wire 14 once the magnet wire 14 is loaded into the magnet wire channel 222. For example, the side walls 228, 230 and/or the bottom 232 may block the magnet wire 14 from moving in a downward direction. Optionally, the separating wall 218 may be positioned to restrict the magnet wire 14 from moving in an upward direction.

The lead wire channels 224 may be defined by notches 236 in the separating wall 218. The lead wires 12 may be lowered into the notches 236 from above the separating wall 218. In the illustrated embodiment, a single lead wire channel 224 is illustrated, however the shear guide 200 may include any number of lead wire channels 224. The lead wire channels 224 may be provided in the separating wall 218 and/or along other portions of the body 202. Optionally, the lead wire channels 224 may be arranged along a common horizontal plane that may be elevated above the plane of the magnet wire channels 222.

The lead wire channel 224 includes side walls 238, 240 meeting at a bottom 242 of the lead wire channel 224. The lead wire channel 224 has an open top 244 that receives the lead wire 12. Optionally, the side walls 240 may define a V-shaped notch 236 that receives the lead wire 12 therein. The notches 236 may have other shapes in alternative embodiments, such as a U-shape. The lead wire channel 224 may receive the lead wire 12 such that a portion of the lead wire 12 is positioned out of and above the lead wire channel 224. The side walls 238 may hold the lead wire 12 to restrict horizontal movement (e.g. side-to-side movement) of the lead wire 12 once the lead wire 12 is positioned in the lead wire channel 224. The lead wire channel 224 may restrict vertical movement of the lead wire 12 once the lead wire 12 is loaded into the lead wire channel 224. For example, the side walls 238, 240 and/or the bottom 242 may block the lead wire 12 from moving in a downward direction. Optionally, a tab or wall may be positioned above the lead wire channel 224 to restrict the lead wire 12 from moving in an upward direction.

The shear guide 200 includes a guide wall 250 at the top 208 of the body 202. The separating wall 218 may extend from the guide wall 250. The guide wall 250 is positioned adjacent the lead wire channels 224 and/or the magnet wire channels 222. The guide wall 250 guides the lead wires 12 into the lead wire channels 224. The guide wall 250 may be used to guide the magnet wires 14 into the magnet wire channel 222, such as in an embodiment that does not include the separating wall 218. During loading of the lead wires 12 into the shear guide 200, the operator may hold the lead wires 12 against the guide wall 250 and lower the lead wires 12 along the guide wall 250 into the corresponding lead wall channels 224. The guide wall 250 operates as a horizontal limit or stop for the lead wires 12 to generally position the lead wires 12 above the lead wire channels 224 for loading the lead wires 12 into the lead wire channels 224.

Figure 7:
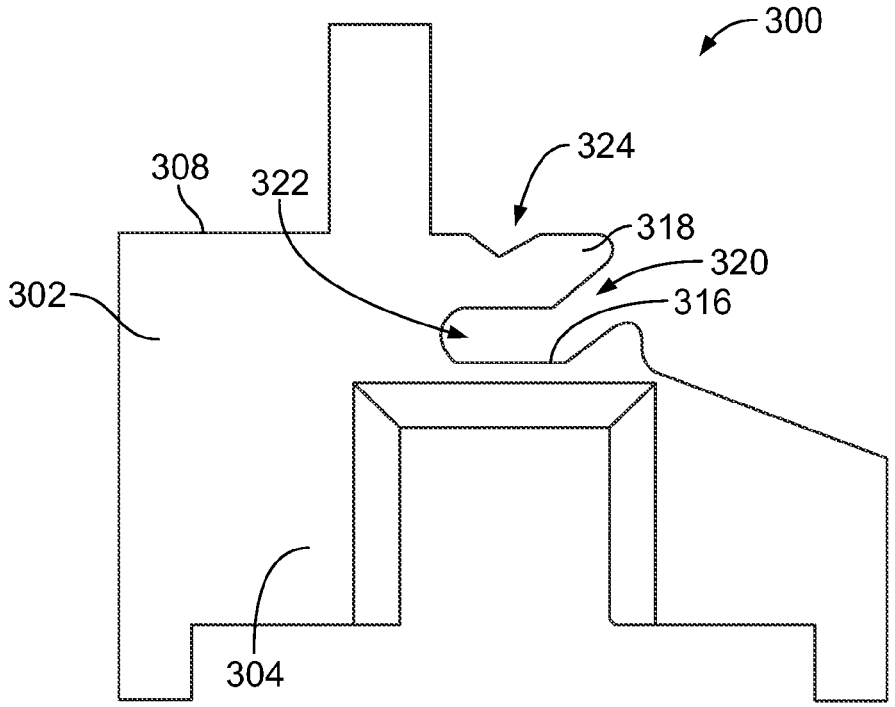
FIG. 7 illustrates a shear guide formed in accordance with an exemplary embodiment.

FIG. 7 illustrates a shear guide 300 formed in accordance with an exemplary embodiment. The shear guide 300 is similar to the shear guide 200. The shear guide 300 includes a body 302 having a shear edge 304 at a front of the body 302. The shear guide 300 includes a platform 316 generally along the top 308 of the body 302. The shear guide 300 includes a separating wall 318 positioned vertically above the platform 316. A slot 320 is defined between the separating wall 318 and the platform 316. In an exemplary embodiment, the magnet wires 14 are received in the slot 320 and supported by the platform 316 while the lead wires 12 are positioned above, and supported by, the separating wall 318. The separating wall 318 separates the magnet wires 14 from the lead wires 12.

The slot 320 defines a magnet wire channel 322. The magnet wire channel 322 is surrounded by the platform 316 and separating wall 318. The magnet wire channel 322 receives and holds one or more magnet wires 14, and may receive lead wire(s) 12 in addition to the magnet wire(s) 14.

The shear guide 300 includes one or more lead wire channels 324 formed by the body 302 that receive and hold corresponding lead wires 12. In an exemplary embodiment, the magnet wire channel 322 is offset vertically below the lead wire channel 324. As such, the magnet wires 14 may be positioned below the lead wires 12 and held below the lead wires 12 for loading into the terminal 10.

Figure 8:
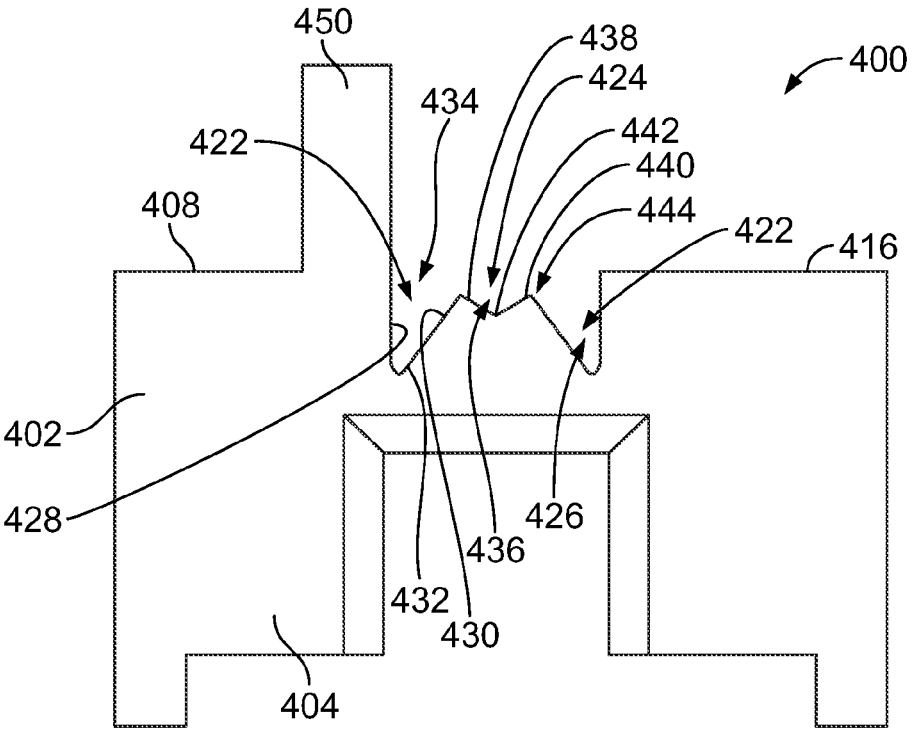
FIG. 8 illustrates a shear guide formed in accordance with an exemplary embodiment.

FIG. 8 illustrates a shear guide 400 formed in accordance with an exemplary embodiment. The shear guide 400 is similar to the shear guide 200. The shear guide 400 includes a body 402 having a shear edge 404 at a front of the body 402. The shear guide 400 includes a platform 416 generally along the top 408 of the body 402.

The shear guide 400 includes one or more magnet wire channels 422 formed by the body 402 that receive and hold corresponding magnet wires 14. The shear guide 400 includes one or more lead wire channels 424 formed by the body 402 that receive and hold corresponding lead wires 12. In an exemplary embodiment, the lead wire channel(s) 424 is vertically offset with respect to the magnet wire channel(s) 422. For example, the magnet wire channels 422 have bottoms that are offset vertically below the lead wire channels 424. As such, the magnet wires 14 may be positioned below the lead wires 12 and held below the lead wires 12 within the terminal 10 during the crimping process. The lead wire channel(s) 424 are horizontally offset with respect to the magnet wire channel(s) 422.

In an exemplary embodiment, the magnet wire channel 422 is formed by a notch 426 in the platform 416. The magnet wire channel 422 includes side walls 428, 430 meeting at a bottom 432 of the magnet wire channel 422. The magnet wire channel 422 has an open top 434 that receives the magnet wire 14. Optionally, the side walls 430 may define a V-shaped notch 426 that receives the magnet wire 14 therein. The side walls 428 may hold the magnet wire 14 to restrict horizontal movement (e.g. side-to-side movement) of the magnet wire 14 once the magnet wire 14 is positioned in the magnet wire channel 422.

The lead wire channel 424 may be defined by a notch 436 in the platform 416. The lead wire channel 424 includes side walls 438, 440 meeting at a bottom 442 of the lead wire channel 424. The bottom 442 of the lead wire channel 424 is elevated above the bottom 432 of the magnet wire channel 422. The bottom 432 of the magnet wire channel 422 is offset at a lower vertical plane than the bottom 442 of the lead wire channel 424. The lead wire channel 424 has an open top 444 that receives the lead wire 12. The open top 444 may be coplanar with the open top 434 of the magnet wire channel 422, or alternatively, may be at a higher elevation than the open top 434. Optionally, the side walls 440 may define a V-shaped notch 436 that receives the lead wire 12 therein. The side walls 438 may hold the lead wire 12 to restrict horizontal movement (e.g. side-to-side movement) of the lead wire 12 once the lead wire 12 is positioned in the lead wire channel 424.

The shear guide 400 includes a guide wall 450 at the top 408 of the body 402. The guide wall 450 is positioned adjacent the channels 422, 424. The guide wall 450 guides the wires 12, 14 into the corresponding channels 424, 422.

Embodiments described herein provide a shear guide configured for use with a terminal crimping machine. The shear guide is used to shear ends of wires that are crimped by an electrical terminal. The shear guide is used to support ends of the wires within the electrical terminal during the crimping process. The shear guide is used to position the wires relative to one another and relative to the electrical terminal for crimping. The shear guide includes both magnet wire channels and lead wire channels that support magnet wires and lead wires, respectively. The channels hold the horizontal and vertical positions of the wires for properly positioning the wires relative to the electrical terminal during the crimping process.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A shear guide for a terminal crimping machine used to splice a magnet wire and a lead wire in a terminal, the shear guide comprising:

a body having a shear edge configured to face the terminal used to splice the magnet wire and the lead wire;

a magnet wire channel formed on a platform of the body and configured to receive and hold the magnet wire at the shear edge; and a lead wire channel formed on a platform of the body and configured to receive and hold the lead wire at the shear edge, the lead wire channel being positioned in close proximity to the magnet wire channel to position the lead wire and the magnet wire in the terminal, wherein the lead wire channel is vertically offset with respect to the magnet wire channel at the shear edge such that both the magnet wire and the lead wire are configured to be sheared at the shear edge.

2. The shear guide of claim 1, wherein the magnet wire channel is offset vertically below the lead wire channel.

3. The shear guide of claim 1, wherein the magnet wire channel is not vertically aligned with respect to the lead wire channel.

4. The shear guide of claim 1, wherein the magnet wire channel includes side walls meeting and a bottom thereof with an open top opposite the bottom, the lead wire channel including side walls meeting at a bottom thereof with an open top opposite the bottom of the lead wire channel, the bottom of the magnet wire channel being offset at a lower vertical plane than the bottom of the lead wire channel.

5. The shear guide of claim 1, further comprising a second magnet wire channel.

6. The shear guide of claim 1, wherein the lead wire channel is offset in a shear direction with respect to the magnet wire channel.

7. The shear guide of claim 1, further comprising a guide wall adjacent the lead wire channel, the guide wall configured to guide the lead wire into the lead wire channel.

8. The shear guide of claim 1, further comprising a separating wall separating the lead wire channel from the magnet wire channel, the lead wire channel being positioned above the separating wall, the magnet wire channel being positioned below the separating wall.

9. The shear guide of claim 8, wherein the lead wire channel is formed in the separating wall.

10. The shear guide of claim 1, wherein the magnet wire channel is defined by a notch formed in the corresponding platform.

11. The shear guide of claim 1, wherein the lead wire channel is defined by a notch formed in the corresponding platform.

12. The shear guide of claim 10, further comprising a separating wall positioned vertically above the platform receiving the magnet wire with a slot defined between the separating wall and the platform, the slot being configured to receive the magnet wire, the separating wall defining the platform configured to support the lead wire above the separating wall.

13. The shear guide of claim 1, wherein the magnet wire channel is configured to restrict horizontal movement of the magnet wire received in the magnet wire channel.

14. The shear guide of claim 1, wherein the magnet wire channel is configured to restrict vertical movement of the magnet wire received in the magnet wire channel.

15. A terminal crimping machine comprising:

crimp tooling for crimping an electrical terminal to magnet wires and lead wires to splice the magnet wires to the corresponding lead wires; and the shear guide of claim 1 positioned adjacent the crimp tooling, the shear guide comprising:

a body having a shear edge configured to face the electrical terminal and crimp tooling;

a magnet wire channel formed on a platform of the body and configured to receive and hold the magnet wire at the shear edge; and a lead wire channel formed on a platform of the body and configured to receive and hold the lead wire at the shear edge, the lead wire channel being positioned in close proximity to the magnet wire channel to position the lead wire and the magnet wire in the terminal, wherein the lead wire channel is vertically offset with respect to the magnet wire channel at the shear edge such that both the magnet wire and the lead wire are configured to be sheared at the shear edge.

16. The terminal crimping machine of claim 15, wherein the magnet wire channel is offset vertically below the lead wire channel.

17. The terminal crimping machine of claim 15, wherein the magnet wire channel includes side walls meeting and a bottom thereof with an open top opposite the bottom, the lead wire channel including side walls meeting at a bottom thereof with an open top opposite the bottom of the lead wire channel, the bottom of the magnet wire channel being offset at a lower vertical plane than the bottom of the lead wire channel.

18. The terminal crimping machine of claim 15, further comprising a separating wall separating the lead wire channel from the magnet wire channel, the lead wire channel being positioned above the separating wall, the magnet wire channel being positioned below the separating wall.

19. The terminal crimping machine of claim 15, wherein the magnet wire channel is defined by a notch formed in the corresponding platform.

20. The terminal crimping machine of claim 19, further comprising a separating wall positioned vertically above the platform receiving the magnet wire with a slot defined between the separating wall and the platform, the slot being configured to receive the magnet wire, the separating wall defining the platform configured to support the lead wire above the separating wall.

* * * * *